US005857274A

United States Patent [19]

Rüdiger et al.

[11] Patent Number: 5,857,274

[45] Date of Patent: Jan. 12, 1999

[54] METHOD OF OPERATING A BUCKET WHEEL EXCAVATOR

[75] Inventors: Hans Jürgen Rüdiger, Lübeck; Dieter Jahn, Magdeburg; Reinhard Trümper, Stockelsdorf, all of Germany

[73] Assignee: Krupp Fordertechnik GmbH, Essen, Germany

[21] Appl. No.: 885,091

[22] Filed: Jun. 30, 1997

[30] Foreign Application Priority Data

Jul. 15, 1996 [DE] Germany ..... 196 28 420.1

[51] Int. Cl.[6] ..... E02F 7/02; E02F 5/02

[52] U.S. Cl. ..... 37/190; 37/95; 37/189; 37/348

[58] Field of Search ..... 37/91, 95, 348, 37/189, 190; 198/626.4, 311, 314, 509; 299/64, 18, 39.2, 67, 73

[56] References Cited

U.S. PATENT DOCUMENTS

| | | | |
|---|---|---|---|
| 4,258,486 | 3/1981 | Barre | 37/190 |
| 4,362,237 | 12/1982 | Olsztynski et al. | 198/509 |
| 5,092,659 | 3/1992 | Grathoff | 37/190 X |
| 5,315,770 | 5/1994 | Campbell | 37/190 X |

FOREIGN PATENT DOCUMENTS

| | | |
|---|---|---|
| 1 634 721 | 10/1966 | Germany . |
| 92 14 346 | 1/1993 | Germany . |

OTHER PUBLICATIONS

Cohrs, H.H., Schaufelradbagger Fur Die Westentasche; bd baumaschinendiest H.2, Feb. 1989, p. 84.

Martin, James W.; "Surface Mining Equipment", Martin Consultants, Inc., Colorado, Aug. 1982, pp. 337, 340, 341.

Hahn, Hans–Peter et al, "Bunkerband Kann Problemlos Forderstillstande . . . ", Werkschrift der Ruhrkohle AG, Feb. 1991, pp. II,III.

Mordstein,W., "Gerate Und Verfahren Zur Reinigung Von Gurtforder–Anlagen", f+h,fordern und heber 35, 1985, Nr.11, pp. 843–848.

Cohrs,H.H.,"Kontinuierlich Arbeitende Gewinnungsgerate Fur Die Selktrive Forderung Im Tagebau",f+h forder und heben 37,1987,Nr.6,pp. 408–411.

DE–AN: P4750/ v.28.9.50; pp. 818–828.

*Primary Examiner*—Thomas B. Will
*Assistant Examiner*—Robert Pezzuto
*Attorney, Agent, or Firm*—Herbert Dubno

[57] ABSTRACT

A bucket-wheel excavator has its bucket-wheel conveyor stopped when a truck is fully loaded so that a new truck can be brought into position, the continuously-operating bucket wheel filling the bucket-wheel chute with a first store of the material. After an empty pass of the dumping conveyor, the bucket-wheel conveyor is driven at a creeping speed and a second store of the material is formed in the receiving chute of the dumping conveyor which is turned onto operate at creeping speed when the material reaches the upper belt drum of the bucket-wheel conveyor belt. Once the empty truck is in position, the belts are accelerated to maximum speed.

15 Claims, 2 Drawing Sheets

METHOD OF OPERATING A BUCKET WHEEL EXCAVATOR

FIELD OF THE INVENTION

Our present invention relates to a method of operating a bucket wheel excavator and, consequently, a method of excavating material utilizing a bucket wheel excavator.

BACKGROUND OF THE INVENTION

A bucket wheel excavator generally comprises a bucket wheel which can be rotated to bring successive buckets into engagement with the ground structure to be excavated so that excavated material is torn from that structure, raised to a higher level and dumped from the bucket. The buckets can be provided with teeth or the like to cut into the material. At least one bucket-wheel belt is provided to carry away the material dumped from the buckets and, to guide this material onto the bucket-wheel conveyor belt, a bucket-wheel chute can be provided.

The bucket-wheel conveyor belt, in turn, can dump the excavated material from the chute into a receiving chute for a dumping conveyor belt which displaces the excavated material still further to an end of the dumping conveyor belt which can overhang a dump truck or other heavy motorized vehicle for carrying away the excavated material. The dumping conveyor belt can also have a drum over which the belt passes and at which the excavated material is discharged into the truck positioned therebelow.

The excavation with a bucket-wheel excavator can be effected in a sloped or inclined operation utilizing a conveyor belt system which operates continuously to remove the excavated material. However, with continuously operating conveyors, the removal of the excavated material by truck is not possible since truck filling and replacement of a full truck by an empty truck is not consistent with continuous operation of the belts. Nevertheless, a continuous operation of the bucket wheel is desirable.

OBJECTS OF THE INVENTION

It is the principal object of the present invention to provide a method of operating a bucket wheel excavator or a method of excavation utilizing a bucket wheel excavator which permits the bucket wheel to operate continuously and nevertheless allows loading a succession of trucks.

Another object of the invention is to eliminate the drawbacks of earlier methods utilizing bucket-wheel excavators.

SUMMARY OF THE INVENTION

In the process of operating a bucket-wheel excavator or of excavating material utilizing a bucket-wheel excavator, these objects are attained by stopping the bucket-wheel conveyor belt when the truck is fully loaded and while the bucket wheel continues to operate so that a first store or bank of the excavated material can build up in the bucket-wheel chute. After the dumping conveyor has operated in an empty mode for a period of time, the dumping conveyor also is stopped and the bucket-wheel conveyor belt is operated at a creeping speed so that material from the first store in the chute and on the bucket-wheel conveyor belt is advanced over the discharge drum at the discharge end of the bucket-wheel belt into the receiving chute for the dumping conveyor. When the material from the first store reaches the drum at the discharge end of the bucket-wheel conveyor, the dumping conveyor is operated at a creeping speed so that the second store of excavated material in the receiving chute is also advanced along the dumping conveyor but at a very reduced speed by comparison with the normal operating speeds of the belts which preferably are the maximum speeds thereof. When another (empty) truck is positioned under the discharge end of the dumping conveyor, both conveyor belts are brought to their normal operating and usually maximum speeds to fill the second truck and allow the loading cycle to repeat, all while the bucket wheel continues to operated.

The method of the invention applies to the operation of a bucket-wheel excavator which comprises, on a chassis, a continuously driven bucket wheel excavating material and carrying excavated material upwardly, a bucket-wheel chute into which material excavated by the bucket wheel is dumped, a bucket-wheel conveyor belt extending upwardly from the bucket-wheel chute for carrying the excavated material away from the bucket-wheel chute, a receiving chute below a belt drum at a discharge end of the bucket-wheel conveyor belt for receiving the excavated material therefrom, and a dumping conveyor belt extending upwardly from the receiving chute and carrying excavated material from the receiving chute over a dumping drum around which the dumping conveyor belt passes into a truck positioned below the dumping drum, whereby the truck is filled at elevated operating speeds of the conveyor belts.

The method comprises the steps of:

(a) upon complete loading of the truck with the excavated material, stopping the bucket-wheel conveyor belt while the bucket wheel continues to operate and the dumping conveyor belt runs empty, thereby collecting in the bucket-wheel chute a first store of the excavated material;

(b) stopping the dumping conveyor belt after an empty run thereof and driving the bucket-wheel conveyor belt at a creeping speed less than the operating speeds to deposit excavated material from the first store in the bucket-wheel chute on the bucket-wheel conveyor belt and transfer excavated material from the bucket-wheel conveyor belt to the receiving chute, thereby forming a second store of the excavated material in the receiving chute while the bucket wheel continues to operate;

(c) when excavated material from the first store on the bucket-wheel conveyor belt reaches the belt drum at the discharge end of the bucket-wheel conveyor belt, driving the dumping conveyor belt at a creeping speed less than the operating speeds;

(d) removing a truck completely loaded in step (a) from beneath the dumping drum of the dumping conveyor belt and positioning a truck to be filled therebeneath;

(e) upon positioning of another truck to be filled beneath the dumping drum of the dumping conveyor belt, accelerating both of the conveyor belts to the operating speeds for filling the other truck with the excavated material; and (f) repeating steps (a) to (e) while the bucket wheel is continuously operated.

The method of the invention allows continuous operation of the bucket-wheel excavator with discontinuous transport of the excavated material away from it.

According to a feature of the invention, the bucket-wheel chute can extend into a pair of guide walls for the bucket-wheel conveyor belt and the receiving chute can be extended into guide walls for the dumping conveyor belt so as to maximize the amount of material which can be accumulated in the first and second stores and along the belt during the period in which the fully-loaded truck is removed an empty truck is brought into position. These lateral walls can extend the full lengths of the two belts and can ensure proper guidance of the excavated material in spite of the relatively high level to which the material can accumulate on the respective belts.

The lateral guide walls of the belts and the walls of the chutes may be so-called "active walls" which can be, for example, moving walls, vibrated walls or walls lined with flight conveyors as may be desirable to promote the movement of material therealong.

The different speeds of the bucket wheel belt and the dumping conveyor belt, the turning on and turning off of the vibrators, etc can all be controlled by a programmed control (programmed computer) or a process control system including a processor and can be initiated in response thereto.

The truckloading operation can be monitored and controlled in that, for example, the truck can be provided with a weighing unit which outputs a radio signal at the end of the loading operation for triggering the computer or controller of the excavator to automatically carry out the step sequence involving the buffering of the excavated material on the belts and chutes. It will be understood that other approaches can be used, for example, a proximity sensor can be provided at the end of the dumping belt or a weighing operation can be carried out using a weighing belt or the like for controlling the buffering of the excavated material.

The excavator can be halted by appropriate means, for example, light curtains or ultrasonic sensors monitoring the material on the dumping belt and determining whether the next truck to be loaded is in the loading position. Of course, when the belts and chutes are fully loaded and a truck is not in position, excavator is stopped. The position of the truck, in turn, can be monitored by light curtains or ultrasonic sensors which can provide a signal for the driver of the truck.

The superstructure of the bucket-wheel excavator, according to the invention can be connected swingably with the crawler structure and a pair of hydraulic cylinders can be provided between this superstructure and the crawler structure to permit leveling of the excavator superstructure. The result is the possibility of use of the excavator on slopes or grades ranging from one to five.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
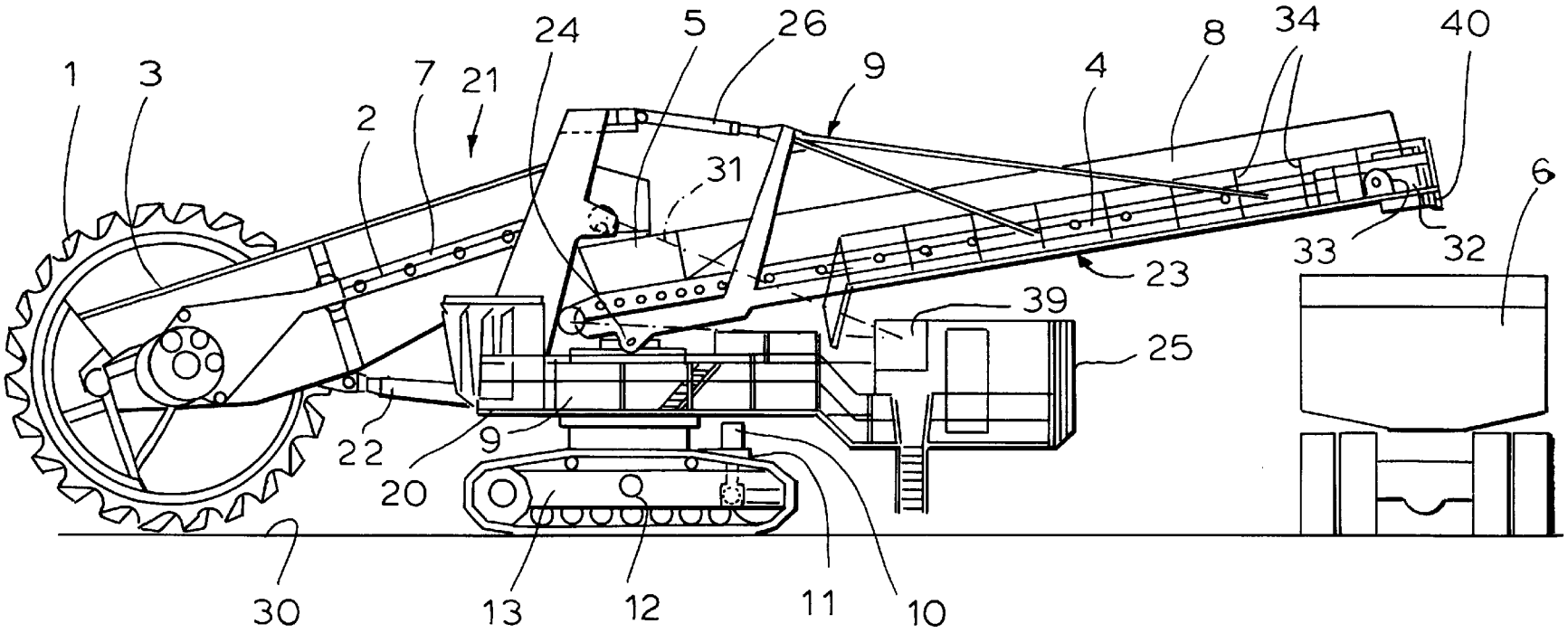
FIG. 1 is a side elevational view of a bucket-wheel excavator according to the invention.
Figure 2:
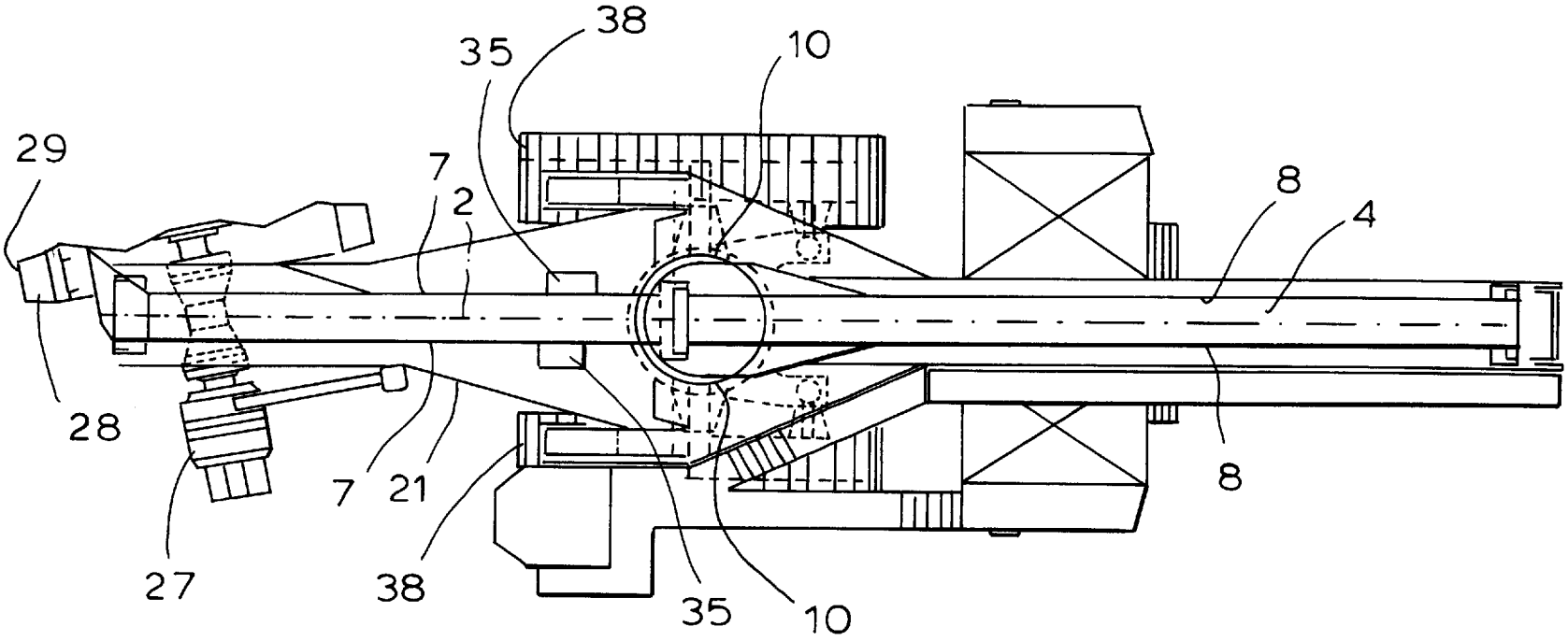
FIG. 2 is a plan view thereof.

The bucket-wheel excavator shown in the drawing comprises a chassis 20 having a front boom 21 articulated thereon and raisable and lowerable by a hydraulic cylinder 22 and a second boom 23 pivotally connected at 24 with the chassis which can carry an operator cabin 25 and the various controls for the apparatus. The boom 23 can be raised and lowered by a hydraulic cylinder 26.

On the boom 21, a bucket wheel 1 is driven by a hydraulic motor 27 and comprises a multiplicity of buckets 28 with cutting edges 29 adapted to bite into the ground structure 30 to be excavated.

This bucket wheel 1 is disposed to drop the excavated material onto a bucket-wheel belt 2 running to a discharge drum 31 at the discharge end of the bucket-wheel conveyor belt and provided at the bottom of a bucket-wheel chute 3.

Below the drum 31 the chute 5 (receiving chute) is provided and the bottom of this chute is formed by the dumping belt 4 whose discharge end 32, with the roller 33 about which the belt passes, can be located above a heavy-duty dump truck 6.

The bucket-wheel belt 2 is flanked by guide plates 7 which extend the length of the bucket wheel belt 2 while the dumping belt 4 is flanked by guide plates 8 which likewise extend the full length of the dumping belt. Conveyor flights 34 may be moved along the walls 8 and the walls 7 or these walls can be provided with vibrators 35 which impart vibratile motion to the walls, thereby promoting movement of excavated material therealong. The superstructure of the excavator comprised of the booms 21 and 23 and the chassis 20 carrying the same can be leveled by a pair of hydraulic cylinders 10 braced between the undercarriage 11 and the superstructure. The undercarriage 11 may have a ball joint on which the superstructure is mounted as represented at 12 and the superstructure can be provided with a track carrier 13 engaged by crawler tracks 38. A controller 39 is connected to the conveyor belt 4 and to the conveyor belt 2 for controlling the speeds thereof and can receive an input from a sensor 40 which responds to the presence of a track for automatically carrying out the operating sequence which has been described.

More specifically, if one assumes that the two belts 2 and 4 are operating at normal, i.e. maximum, speeds, excavation proceeds by removal of material by the bucket wheel 1, dumping of this material into the chute 3 and onto the bucket-wheel conveyor belt 2, transfer of this material to the chute 5 and the dumping conveyor 4 and passage of the material into the truck 6. The amount of material of each of the belts is a minimum and no significant store of material is contained in the chutes.

When, however, the truck 6 is filled as detected by the sensor 40, the conveyor 2 is turned off while the bucket wheel continues to operate and the dumping conveyor 4 continues to run until empty and then travels in an empty pass.

Since the bucket wheel continues to operate, material continues to be dumped through chute 3 onto the conveyor 2 which, as noted, is now immobile during the period in which the loaded truck 6 moves away and a new truck, i.e. an empty truck is brought into position. The result is the formation of a first store of the excavated material in the chute 3.

After the dumping conveyor belt 4 has traveled empty for a time, it is stopped and the bucket-wheel conveyor belt 2 is driven at a creeping speed which can be a small fraction of the maximum speed, say 1/10th of the maximum speed or less. As a result, the excavated material of the first store climbs with the belt to the discharge end thereof in the region of the drum 31. The material passes over this drum into the chute 5 and onto the dumping belt 4. The latter is only started also at a creeping speed which is a similar small fraction of its normal or maximum speed, when the first store of material reaches the drum 31. The result is a slow built up of the excavated material on the two belts and in the two chutes as the bucket wheel 1 continues to operate.

When the empty truck is properly positioned beneath the discharge end 32 of the dumping conveyor 4 as sensed by the detector 40, the conveyor belts are accelerated to their maximum speeds by the controller 39 so that the new truck 6 is filled at a normal rate and the filling process can be repeated to allow the excavator to operate continuously while the material is carried off discontinuously.

We claim:

1. A method of operating a bucket-wheel excavator which comprises, on a chassis, a continuously driven bucket wheel excavating material and carrying excavated material upwardly, a bucket-wheel chute into which material excavated by the bucket wheel is dumped, a bucket-wheel conveyor belt extending upwardly from said bucket-wheel chute for carrying said excavated material away from said bucket-wheel chute, a receiving chute below a belt drum at a discharge end of said bucket-wheel conveyor belt for receiving said excavated material therefrom, and a dumping conveyor belt extending upwardly from said receiving chute and carrying excavated material from said receiving chute over a dumping drum around which said dumping conveyor belt passes into a truck positioned below said dumping drum, whereby said truck is filled at elevated operating speeds of said conveyor belts, said method comprising the steps of:

(a) upon complete loading of said truck with said excavated material, stopping said bucket-wheel conveyor belt while said bucket wheel continues to operate and said dumping conveyor belt runs empty, thereby collecting in said bucket-wheel chute a first store of said excavated material;

(b) stopping said dumping conveyor belt after an empty run thereof and driving said bucket-wheel conveyor belt at a creeping speed less than said operating speeds to deposit excavated material from said first store in said bucket-wheel chute on said bucket-wheel conveyor belt and transfer excavated material from said bucket-wheel conveyor belt to said receiving chute, thereby forming a second store of said excavated material in said receiving chute while said bucket wheel continues to operate;

(c) when excavated material from said first store on said bucket-wheel conveyor belt reaches said belt drum at said discharge end of said bucket-wheel conveyor belt, driving said dumping conveyor belt at a creeping speed less than said operating speeds;

(d) removing a truck completely loaded in step (a) from beneath said dumping drum of said dumping conveyor belt and positioning a truck to be filled therebeneath;

(e) upon positioning of another truck to be filled beneath said dumping drum of said dumping conveyor belt, accelerating both of said conveyor belts to said operating speeds for filling said other truck with said excavated material; and (f) repeating steps (a) to (e) while said bucket wheel is continuously operated.

2. The method defined in claim 1, further comprising the step of confining the excavated material on said bucket-wheel conveyor belt between a pair of guide plates extending substantially at a height of said bucket-wheel chute over the entire length of said bucket-wheel conveyor belt.

3. The method defined in claim 2, further comprising the step of promoting movement of said material along said plates.

4. The method defined in claim 3 wherein movement of said material along said plates is promoted by vibrating said plates.

5. The method defined in claim 3 wherein said movement of said material is promoted along said plates by entraining said material with flights of a flight conveyor.

6. The method defined in claim 1, further comprising the step of confining the excavated material on said dumping conveyor belt between a pair of guide plates extending substantially at a height of said receiving chute over the entire length of said bucket-wheel conveyor belt.

7. The method defined in claim 6, further comprising the step of promoting movement of said material along said plates.

8. The method defined in claim 6 wherein movement of said material along said plates is promoted by vibrating said plates.

9. The method defined in claim 6 wherein said movement of said material is promoted along said plates by entraining said material with flights of a flight conveyor.

10. The method defined in claim 1, further comprising leveling a superstructure of said excavator relative to a crawler undercarriage thereof by mounting said superstructure so that it can pivot cardanically on said undercarriage and controlling the level of said superstructure with two hydraulic cylinders braced between said superstructure and said undercarriage.

11. A bucket-wheel excavator which comprises:

a crawler undercarriage;

a chassis mounted swivelably on said undercarriage;

a continuously driven bucket wheel on said chassis excavating material and carrying excavated material upwardly;

a bucket chute on said chassis positioned to receive material excavated by said bucket wheel and into which material is dumped by said bucket wheel;

a bucket-wheel conveyor belt extending upwardly away form said bucket-wheel chute for carrying said excavated material away form said bucket-wheel chute;

a receiving chute below a belt drum at a discharge end of said bucket-wheel conveyor belt for receiving excavated material therefrom;

a dumping-conveyor belt extending upwardly from said receiving chute and carrying excavated material from said receiving chute over a dumping drum around which said dumping-conveyor belt passes into a truck positionable below said dumping drum; and control means operatively connected to said conveyor belt for:

(a) upon complete loading of said truck with said excavated material, stopping said bucket-wheel conveyor belt while said bucket wheel continues to operate and said dumping conveyor belt runs empty, thereby collecting in said bucket-wheel chute a first store of said excavated material;

(b) stopping said dumping conveyor belt after an empty run thereof and driving said bucket-wheel conveyor belt at a creeping speed less than said operating speeds to deposit excavated material from said first store in said bucket-wheel chute on said bucket-wheel conveyor belt and transfer excavated material from said bucket-wheel conveyor belt to said receiving chute, thereby forming a second store of said excavated material in said receiving chute while said bucket wheel continues to operate;

(c) when excavated material from said first store on said bucket-wheel conveyor belt reaches said belt drum at said discharge end of said bucket-wheel conveyor belt, driving said dumping conveyor belt at a creeping speed less than said operating speeds; and (d) upon positioning of another truck to be filled beneath said dumping drum of said dumping conveyor belt, accelerating both of said conveyor belts to said operating speeds for filling said other truck with said excavated material.

12. A bucket-wheel excavator defined in claim 11 wherein each of said conveyor belts is flanked by a pair of guide plates extending to the height of the respective chute over substantially the entire length of the respective conveyor belt.

13. A bucket-wheel excavator defined in claim 12, further comprising means for vibrating said plates.

14. A bucket-wheel excavator defined in claim 12, further comprising the flight conveyors displaceable along said plates for promoting movement of said material therealong.

15. A bucket-wheel excavator defined in claim 11, further comprising a pair of hydraulic cylinders connected between said undercarriage and said chassis for leveling said bucket-wheel excavator.

* * * * *